US012245676B2

(12) United States Patent
Chodieva

(10) Patent No.: US 12,245,676 B2
(45) Date of Patent: Mar. 11, 2025

(54) ELECTRONIC DEVICE CASE AND A MAKE-UP APPLICATOR ASSEMBLY FOR USE WITH AN ELECTRONIC DEVICE CASE

(71) Applicant: POUT CASE LIMITED, London (GB)

(72) Inventor: Nafissa Chodieva, London (GB)

(73) Assignee: Pout Case Limited, London (GB)

( * ) Notice: Subject to any disclaimer, the term of this patent is extended or adjusted under 35 U.S.C. 154(b) by 0 days.

(21) Appl. No.: 17/625,480

(22) PCT Filed: Jul. 8, 2020

(86) PCT No.: PCT/EP2020/069259

§ 371 (c)(1),
(2) Date: Jan. 7, 2022

(87) PCT Pub. No.: WO2021/005113

PCT Pub. Date: Jan. 14, 2021

(65) Prior Publication Data

US 2022/0265022 A1 Aug. 25, 2022

(30) Foreign Application Priority Data

Jul. 8, 2019 (GB) ..... 1909786

(51) Int. Cl.
*A45D 33/26* (2006.01)
*A45C 11/00* (2006.01)
(Continued)

(52) U.S. Cl.
CPC ..... *A45D 33/26* (2013.01); *A45C 11/00* (2013.01); *A45D 33/008* (2013.01); *A45D 33/20* (2013.01);
(Continued)

(58) Field of Classification Search
CPC ..... A45D 33/26; A45D 40/24; A45D 40/18; A45D 33/20; A45D 33/008; A45C 11/00;
(Continued)

(56) References Cited

U.S. PATENT DOCUMENTS 4,421,127 A * 12/1983 Geer ..... A45D 40/22 206/823
8,602,039 B1 * 12/2013 Gindi ..... H04M 1/21 206/823
(Continued)

FOREIGN PATENT DOCUMENTS

KR 20140002944 U 5/2014
KR 1020180062840 A 6/2018
(Continued)

OTHER PUBLICATIONS

International Search Report and Written Opinion dated Sep. 24, 2020, for Application No. PCT/EP2020/069259.
(Continued)

*Primary Examiner* — Rafael A Ortiz
(74) *Attorney, Agent, or Firm* — Conley Rose, P.C.

(57) ABSTRACT

An electronic device case includes a housing to hold an electronic device on a first side of the case; a slidable drawer provided on an opposite side of the case, slidably retractable from the housing, the drawer containing removably selectable trays for storing make-up, and being arranged to magnetically interact with an inner surface of the drawer; and a make-up applicator arranged within the drawer, the make-up applicator being configured to magnetically interact with an inner surface of the drawer to enable the brush to be removably fixed in position within the drawer and to be released when gripped by a user.

12 Claims, 13 Drawing Sheets

(51) Int. Cl.

| | |
|---|---|
| ***A45D 33/00*** | (2006.01) |
| ***A45D 33/20*** | (2006.01) |
| ***A45D 40/18*** | (2006.01) |
| ***A45D 40/24*** | (2006.01) |
| ***A46B 9/02*** | (2006.01) |
| ***A46B 15/00*** | (2006.01) |

(52) U.S. Cl.
CPC ..... *A45D 40/18* (2013.01); *A45D 40/24* (2013.01); *A46B 9/021* (2013.01); *A46B 15/0061* (2013.01); *A46B 15/0095* (2013.01); *A45C 2011/002* (2013.01); *A46B 2200/1046* (2013.01)

(58) Field of Classification Search
CPC ..... A45C 2011/002; A46B 2200/1046; A46B 15/0095; A46B 15/0061; A46B 9/021
USPC ..... 206/581, 209, 361, 235
See application file for complete search history.

(56) References Cited

U.S. PATENT DOCUMENTS

| | | | | |
|---|---|---|---|---|
| 8,833,379 | B1 * | 9/2014 | Kaplan | A45D 33/26 206/823 |
| 9,237,791 | B2 | 1/2016 | Hirst | |
| 2003/0000865 | A1 | 1/2003 | Carlino | |
| 2006/0090277 | A1 * | 5/2006 | Petit | A45D 33/00 15/144.1 |
| 2009/0166247 | A1 | 7/2009 | Gindi | |
| 2011/0089077 | A1 * | 4/2011 | Ziemba | A45C 11/00 206/229 |
| 2011/0089078 | A1 * | 4/2011 | Ziemba | A45C 13/10 206/581 |
| 2014/0216976 | A1 | 8/2014 | Conarro | |
| 2014/0251368 | A1 * | 9/2014 | Lawson | A45C 13/02 206/37 |
| 2015/0159425 | A1 * | 6/2015 | Algar | H01F 41/0286 24/303 |
| 2015/0359325 | A1 * | 12/2015 | McCarthy | A46B 15/0095 15/160 |
| 2016/0014922 | A1 * | 1/2016 | Banerjee | A45C 7/0031 206/38 |
| 2017/0035184 | A1 * | 2/2017 | Sagel | A45D 33/008 |
| 2018/0069585 | A1 * | 3/2018 | Azodi | H04W 88/02 |
| 2019/0039061 | A1 * | 2/2019 | Bornmann | B01L 9/52 |
| 2019/0069661 | A1 * | 3/2019 | Worley | A45D 33/26 |
| 2019/0261763 | A1 * | 8/2019 | Seguin | A45D 40/24 |

FOREIGN PATENT DOCUMENTS

| | | | | |
|---|---|---|---|---|
| WO | WO-2017055840 | A1 * | 4/2017 | A45C 11/00 |
| WO | 2019013402 | A1 | 1/2019 | |

OTHER PUBLICATIONS

UK IPO Search Report dated Dec. 6, 2019, for Application GB 1909786.4.

* cited by examiner

ELECTRONIC DEVICE CASE AND A MAKE-UP APPLICATOR ASSEMBLY FOR USE WITH AN ELECTRONIC DEVICE CASE

CROSS-REFERENCE TO RELATED APPLICATIONS

This application is a 35 U.S.C. § 371 national stage application of PCT/EP2020/069259 filed Jul. 8, 2020, and entitled "An Electronic Device Case and a Make-up Applicator Assembly for Use With an Electronic Device Case" which claims priority to UK patent application GB1909786.4 filed Jul. 8, 2019, and entitled "An Electronic Device Case and a Make-up Applicator Assembly for Use With an Electronic Device Case", both of which are incorporated herein in their entirety for all purposes.

BACKGROUND

The present description relates to an electronic device case and a make-up applicator assembly for use with an electronic device case. In particular embodiments, the description relates to a mobile telephone case.

It is known to provide makeup material (hereinafter "make-up") in a smart phone case. This provides a convenient way for a user to ensure that they have their make-up with them since people nowadays almost always have their mobile telephones with them when they go out.

A number of applications exist which describe the provision of some form of make-up compartment within a smart phone case. Examples include WO-A-2017/055,840, U.S. Pat. No. 8,602,039, US-A-2011/089,078, US-A-2018/344,004, US-A-2014/144,796 and US-A-2018/069,585. The disclosed phone case in WO-A-2017/055,840 works well although improvements in the devices of all of the above listed applications are desired.

FIGS. 1 and 2 show views of the smart phone case with make-up compartment described in WO-A-2017/055,840. As can be seen and as described in WO-A-2017/055,840, smart phone case 1 is provided having resilient side walls 2 and a back wall 3, with camera and control apertures 4. Downwards of the camera aperture, the side walls blend out to a thickening of the case, with inward facing guides and ribs along the sides of the case. The guides are joined by a similar formation 7 without a rib, from side to side close to the main camera aperture, but not at the end remote from the camera.

A compartment 8 with a further back wall 9, peripheral walls 10 and forward-facing receptacles 11 is provided. The peripheral walls at the side of the compartment 8 have grooves complimentary to the ribs, whereby the compartment can be slid in to extend only within the extent of the side walls 2 or slid out to expose the compartments. In this configuration, as shown in FIGS. 1 and 2, make-up can be applied by a user, using the smart phone camera in "selfie" mode as a mirror.

SUMMARY

According to a first aspect of the present disclosure, there is provided an electronic device case, comprising: a housing to hold an electronic device on a first side of the case; a slidable drawer provided on an opposite side of the case, slidably retractable from the housing, the drawer containing removably selectable trays for storing make-up, and being arranged to magnetically interact with a surface, such as an inner surface, of the drawer; and a make-up applicator arranged within the drawer, the make-up applicator being arranged to magnetically interact with a surface, such as an inner surface, of the drawer to enable the brush to be removably fixed in position within the drawer and to be released when gripped by a user.

In an embodiment, the housing is sized to receive a mobile telephone.

In an embodiment, the housing is sized to receive a smartphone.

In an embodiment, the electronic device case comprises a brush removably fixed in position within the drawer for release when gripped by a user.

In an embodiment, the brush is formed of a magnetic material. In one embodiment the brush is formed of metal such as stainless steel and has arranged within it one or more permanent magnets to ensure that as a combined unit the brush is magnetic.

In an embodiment, the brush is formed of a metal arranged to be magnetically attracted to magnet provided within the housing.

In an embodiment, the electronic device case comprises a generally cylindrical brush sleeve and being arranged to be to be removably fixed in position within the drawer for release when gripped by a user.

In an embodiment, the electronic device case comprises a magnetic sheet arranged to cover a majority of the area of the drawer for engaging with make-up holding trays or and an applicator assembly.

In an embodiment, the brush sleeve is metal and arranged to be magnetically attracted to a magnetic sheet within the housing.

In an embodiment, the drawer has a stop to limit the amount it can be opened and to reduce the risk of undesired removal of the drawer from the house.

In an embodiment, the strength of the magnetic field varies so as to define at least one area of high magnetic field strength and one area of lower magnetic field strength.

In an embodiment, the areas at the centre of the sheet are stronger magnets than the sides.

In an embodiment, the sheet is sheet of non-magnetic material with a number of discrete magnets positioned integrally within the sheet.

According to a second aspect of the present disclosure, there is provided a make-up applicator assembly for use with an electronic device case according to the first aspect of the present disclosure, the applicator comprising a generally cylindrical housing made up of a metal for attraction to the magnetic sheet of the electronic device case.

In an embodiment, the applicator is a brush. In a preferred embodiment, the applicator is a brush with filaments at both ends and a handle for holding in the middle.

In an embodiment, the applicator comprises a telescopically arranged brush within the generally cylindrical housing.

According to a third aspect of the present disclosure, there is provided an electronic device case, comprising: a housing to hold an electronic device on a first side of the case, the housing comprising a rear wall defining a rear surface of the device case; a connector provided on the rear wall; and a make-up case releasably attached to the connector on the rear wall of the case.

In an embodiment, the make-up case comprises an outer housing and a drawer, slidably retractable from the outer housing, the drawer containing removably selectable trays for storing make-up, and being arranged to magnetically interact with an inner surface of the drawer.

In an embodiment the make-up case comprises a make-up applicator arranged within the drawer, the make-up applicator being arranged to magnetically interact with an inner surface of the drawer to enable the applicator to be removably fixed in position within the drawer and to be released when gripped by a user.

According to a further aspect of the present disclosure, there is provided an electronic device case, comprising: a housing to hold an electronic device on a first side of the case;

a drawer provided on an opposite side of the case, slidably retractable from the housing, the drawer containing removably arranged tray or tray assemblies for storing make-up, and being arranged to magnetically interact with an inner surface of the drawer; and a make-up applicator arranged within the drawer, the make-up applicator being arranged to magnetically interact with an inner surface of the drawer to enable the brush to be removably fixed in position within the drawer and to be released when gripped by a user, in which the drawer includes a sheet of magnetic material and in which the generated strength of the magnetic field varies across the sheet of magnetic material so as to define at least one area of high magnetic field strength and one area of lower magnetic field strength.

In one example, this is achieved by providing a strip of material of high magnetic permeability in a region of the magnetic sheet where it is expected that the applicator, such as the brush, will be stored. This means that the magnetic field experienced by the applicator will be reduced as compared to other parts of the magnetic sheet where the high magnetic permeability material is not provided.

In one embodiment the sheet is formed of metal such as stainless steel and has arranged within it one or more permanent magnets to ensure that as a combined unit the sheet is magnetic. Areas of higher magnetic field strength may be provided with a higher concentration of permanent magnets per unit area. Preferably the permanent magnets are small, say 0.5-3 mm across, preferably 1-2 mm across. The magnets may be any suitable shape, such as circular, oval, rectangular, square, rhombic, trapezoidal etc. The density of magnets per square centimetre is varied to achieve a desired magnetic field strength in any particular region of the sheet. In other words, a higher density per unit area, e.g. square centimetre, may be provided in areas where trays are to be arranged, as compared to those areas where the applicator will be stored in use. In one example, a magnetic powder or magnetic particles are used in the formation of the magnetic sheet. A non-magnetic material can be mixed with the powder to form a magnetic layer of the sheet or the entire sheet itself, and the relative concentration of magnetic powder in the magnetic layer or sheet is varied across the area of the sheet so as to achieve the desired effect of varying strength magnetic field across the sheet.

BRIEF DESCRIPTION OF THE DRAWINGS

Embodiments of the present disclosure will now be described in detail with reference to the accompanying drawings, in which.

DETAILED DESCRIPTION

Figure 1:
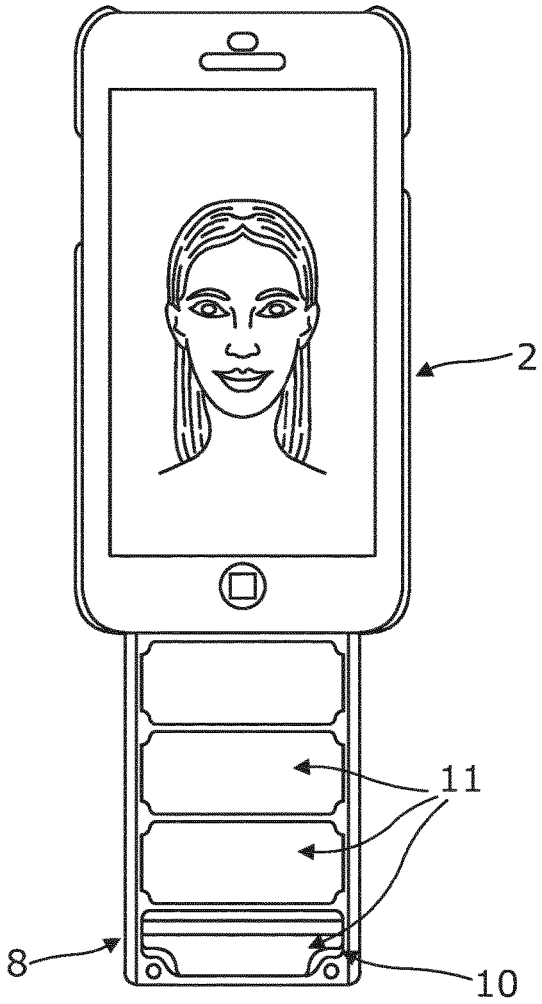
FIGS. 1 and 2 show examples of a smart phone case with make-up compartment.
Figure 2:
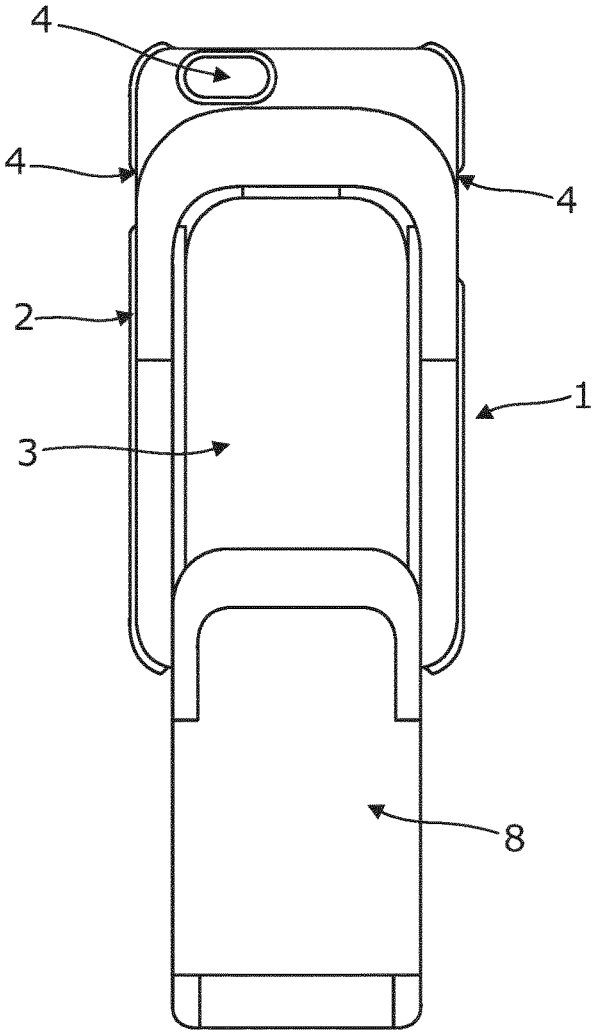
Figure 3:
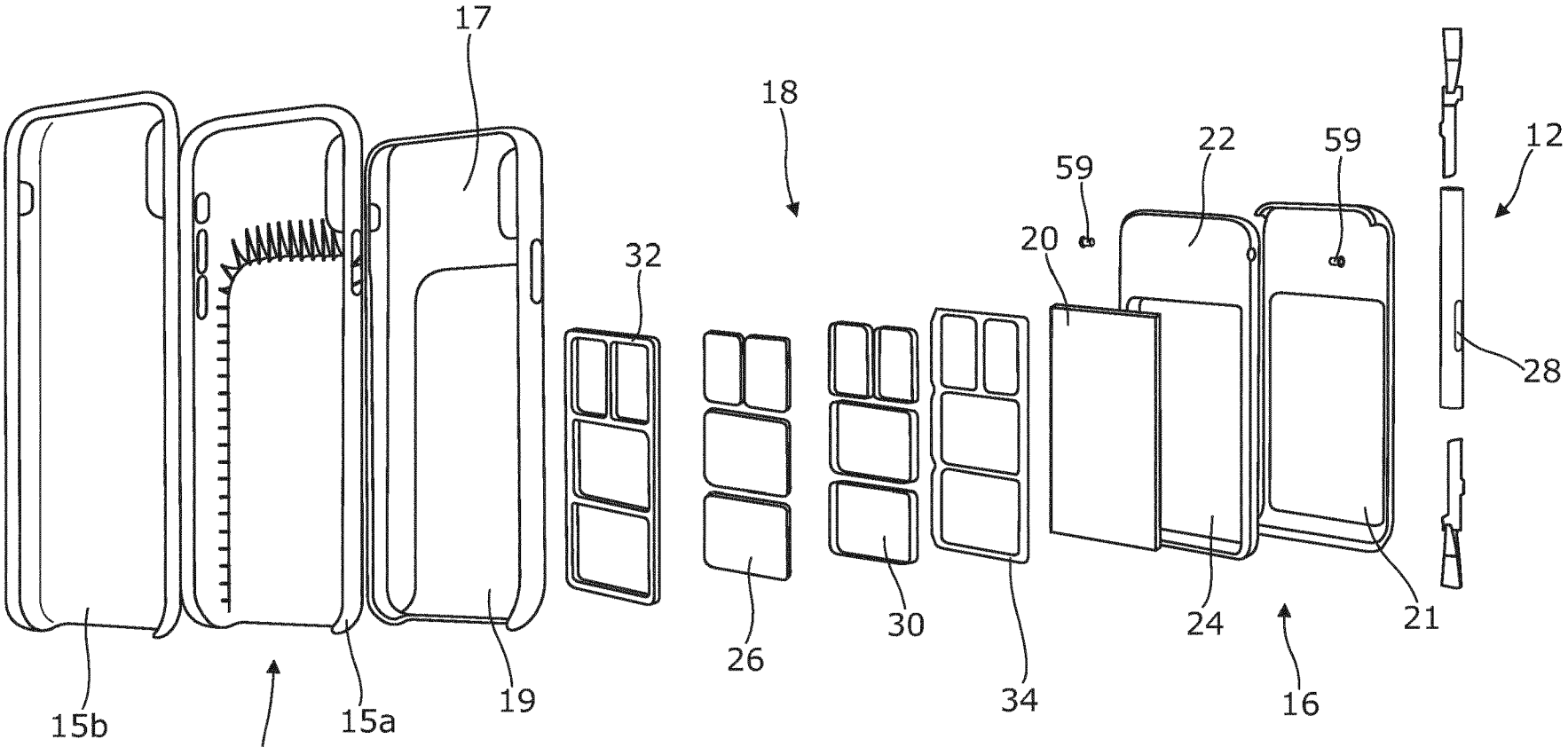
FIG. 3 shows a schematic and exploded view of a smart phone case with make-up compartment.

FIG. 3 shows a smart phone case assembly in exploded form. The smart phone case assembly includes both a smart phone case 14 and a make-up assembly 18. The smart phone case assembly comprises a phone case shell 15*a* and a lining 15*b* together with an outer back plate 17. The outer back plate 17 of the smart phone case assembly has a rear opening 19 which, in use is covered by an outer rear section 21. The outer rear section 21, together the rear surface of the phone case shell 15 houses the make-up assembly 18. An applicator assembly 12 in the form of a brush is provided which is sized and arranged to fit within the make-up assembly 18 to provide for convenient use and interaction by a user, as will be described in greater detail below.

In general, the smart phone case assembly has an overall outer envelope, and includes the smart phone case 14 which is sized and arranged to receive a mobile smart phone and the make-up assembly 18. The make-up assembly 18 serves to house make-up and various components such as trays (sometimes referred to in the art as "godets") for holding the make-up. A magnetic sheet 20 is provided within the make-up assembly 18 and its function will be described in greater detail below.

Importantly, an inner tray 22 is provided with an opening 24 sized to receive, in use, both a make-up assembly 18 and the applicator brush 12. This means that within the inner tray 22, a user is able to store both the desired trays including make-up elements 26 and a brush or applicator assembly 12.

The applicator or brush assembly 12 is made of a material such that in use, it will be attracted to and magnetically engaged with the magnetic sheet 20. The applicator or brush assembly 12 may be provided with an outer housing or sleeve 28 which is generally cylindrical and/or made of a metal material that would be attracted to a magnet or some other magnetic material.

The make-up assembly 18 includes metallic trays 30 together with upper and lower tray holders 32 and 34, respectively.

The magnetic sheet is arranged within the opening 24 and via magnetic interaction with the trays 30, ensures that the trays are removably anchored in position within the make-up assembly housing and specifically within the opening 24 in tray 20. The nature of the magnetic interaction means that a user can as desired, easily and reconfigurably change the specific trays stored within the make-up case. Furthermore, the brush or applicator assembly 12, being positioned within the opening 24 will always be easily accessible for a user. It will be appreciated that instead of (or as well as) providing a magnetic sheet and metallic trays and applicator, such a metallic sheet may be provided, and the trays and brush may be formed of a magnetic material.

Figure 4:
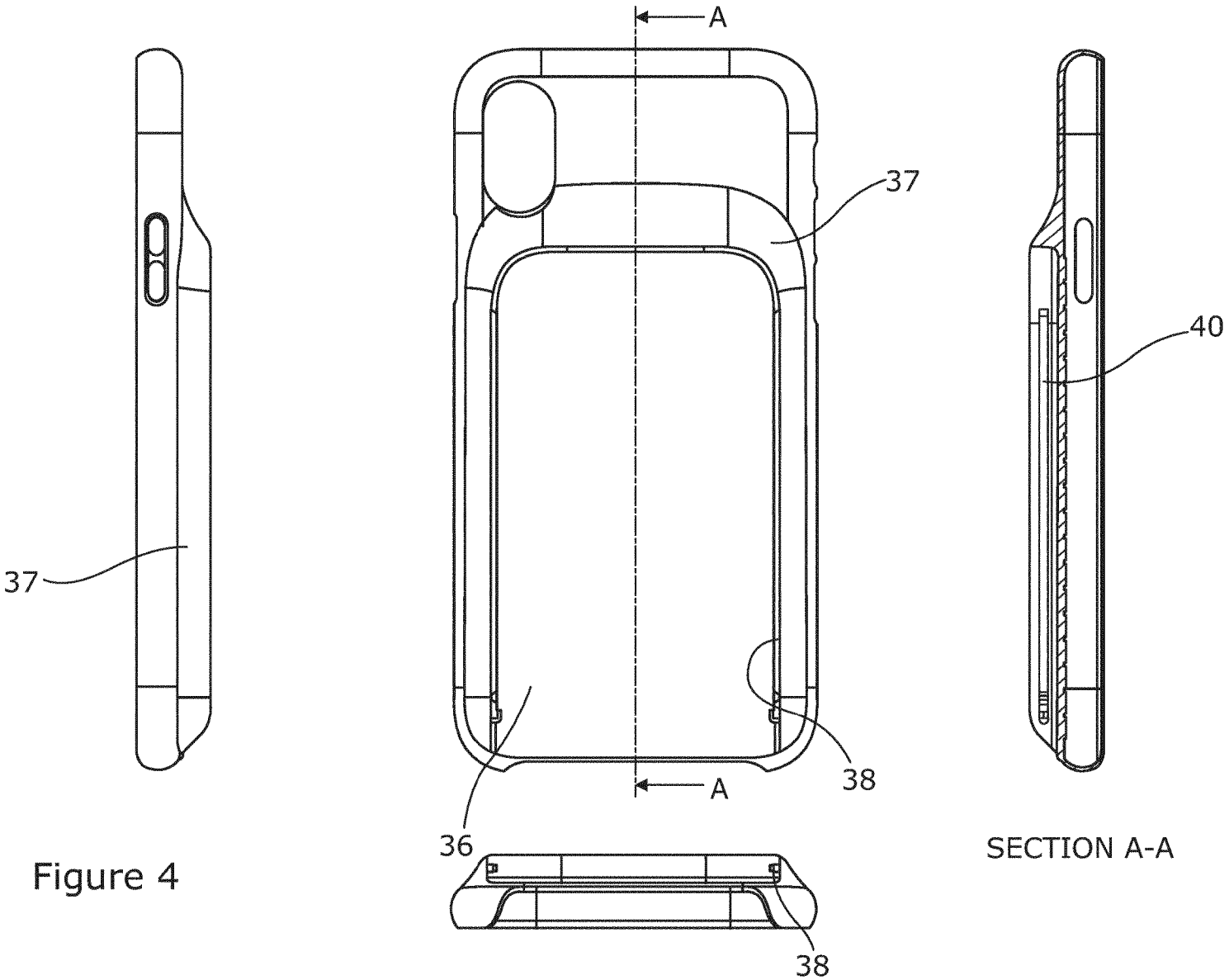
FIG. 4 shows views of a phone case shell from the assembly of FIG. 3.

FIG. 4 shows views (opposite side views, a rear plan view and a bottom end view) of a phone case shell which is made up in effect of the shell 15*a*, the lining 15*b*, and the back plate 17 of FIG. 3. As can be seen, there are provided the usual openings within a smart phone case that enable a camera and the phone controls to be accessed by a user without removing the phone from the case. In addition, the case shell is shaped so as to define an area 36 for housing a make-up compartment. The area 36 has raised chamfered edges 37 that define a volume in which the make-up assembly 18 will in use be positioned. Rails 38 (or grooves) are provided for engagement with guides (or rails) on a make-up drawer to enable slidable retraction of the make-up drawer from the phone case shell.

Figure 5:
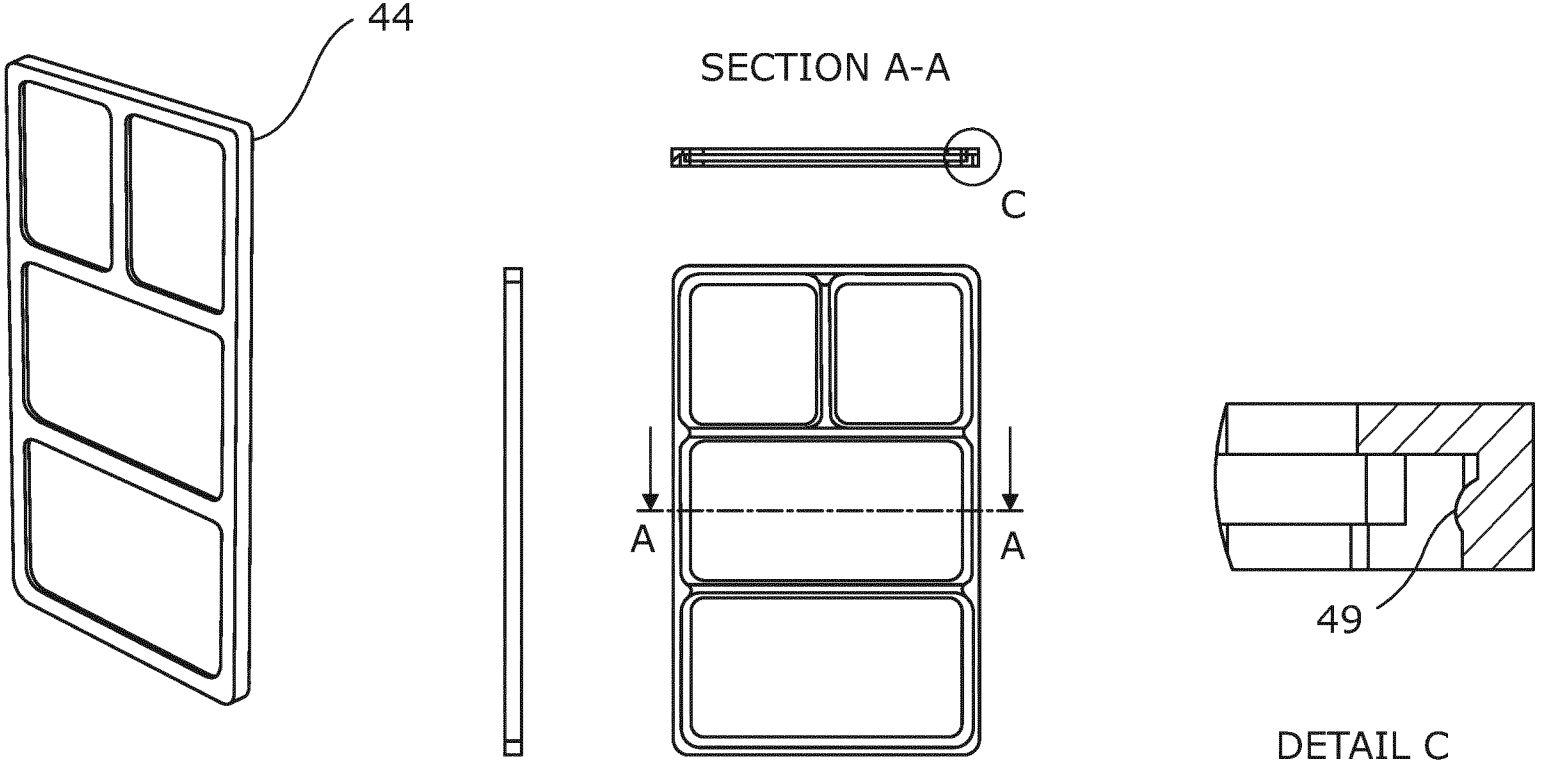
FIGS. 5 and 6 shows schematic views of Tray components from the assembly of FIG. 3.
Figure 6:
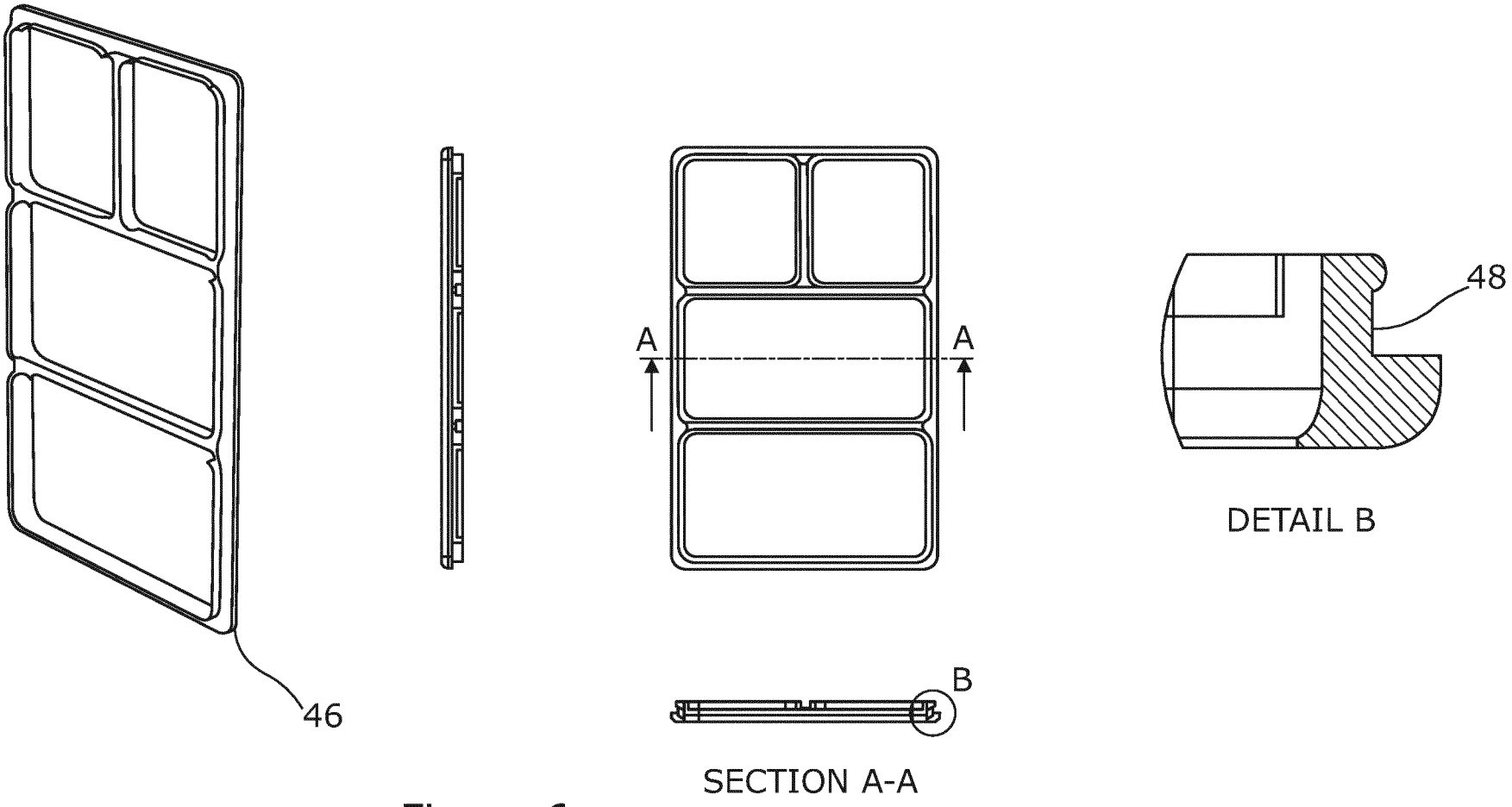

Referring to FIGS. 5 and 6, an example of a tray or make-up assembly 18 is shown. FIG. 5 includes the upper tray holder 44 and FIG. 6 shows the lower tray holder 46. As can be seen, side grooves 48 and 49 are provided respectively on the lower and upper tray holders which together define a channel for engagement with the rails 38 of the make-up assembly 18. This enables a slidable engagement with respect to the smart phone shell 14.

The slidable drawer is retractable from the housing assembly and the magnetic arrangement for the storing of the trays enables a variable selection of make-up to be made in accordance with a user's preferences and desires. In an embodiment a stop 59 (see FIGS. 3 and 7) may be provided to limit movement of the drawer and to stop it being inadvertently entirely removed from the case. This could be a spring biased projection or the like or some other equivalent component.

Importantly, the provision of a make-up applicator 12 in the form of brush 28 within the make-up case and arranged to magnetically interact with the case (i.e. the magnetic sheet 20 within it) ensures that a user is unlikely to be caught in a situation where they have the make-up but no means of applying it. Furthermore, the magnetic engagement ensures that an applicator can be changed for a different one when a user requires a different form of applicator or even simply just wants to change it because the existing one has broken or worn out. The magnetic engagement of the applicator with the sheet in the case ensures that it will not easily be lost or mislaid.

The magnetic sheet may be formed of any appropriate magnetic material and is selected so as to provide sufficient magnetic force for engagement of the trays 30 and the brush assembly 12 without making the connection so strong that it is difficult in use to remove the brush when needed.

In one example, the magnetic sheet 20 may be formed of a uniform magnetic material such that the magnetic force that the sheet is able to apply is constant and uniform across the entirety of the surface area of the sheet 20. In another example, it may be provided that the magnetic sheet has variable magnetic field strength across its surface area such that different parts of the sheet will provide a different strength of holding force on respective components. This is particularly desirable in the case of a make-up case as described herein since it means that a stronger magnetic force can be used for holding of the trays 30 in position whereas a weaker and more easily overcome force can be used for holding of the applicator assembly 12.

One convenient and easy way for achieving this variability is by providing a strip of material of high magnetic permeability arranged in a region of the magnetic sheet where it is expected that the applicator 12 will be stored. This means that the magnetic field experienced by the applicator assembly 12 will be reduced as compared to other parts of the magnetic sheet where the high magnetic permeability material is not provided.

In one example, the sheet is formed of metal such as stainless steel and has arranged within it or on one side of it (typically the reverse side to that which will engage with the trays and applicator) one or more permanent magnets to ensure that as a combined unit the sheet is magnetic. Areas of higher magnetic field strength may be provided with a higher concentration of permanent magnets per unit area. Preferably the permanent magnets are small, say 0.5-3 mm across, preferably 1-2 mm across. The magnets may be any suitable shape, such as circular, oval, rectangular, square, rhombic, trapezoidal etc. The density of magnets per square centimetre is varied to achieve a desired magnetic field strength in any particular region of the sheet. In other words, a higher density per unit area, e.g. square centimetre, may be provided in areas where trays are to be arranged, as compared to those areas where the applicator will be stored in use.

In one example, in which the magnetic sheet may comprise a layer of non-magnetic material, e.g. a plastic or a polymer, with a number of discrete magnets positioned on or integrally within the layer so that in combination the non-magnetic layer and the discrete magnets define the magnetic sheet.

In one example, the area of lower magnetic field strength is provided on one side and extends for the length of the magnetic sheet, i.e. a length generally parallel to the longitudinal axis of the mobile telephone, such that the applicator or brush can easily be stored at one side. In an alternative example the area of lower magnetic field strength is provided at the top or bottom of the sheet extending across the sheet, i.e. generally parallel to the transverse axis of the mobile telephone. Areas of lower magnetic field strength can be provided in either or both of these regions (along or across the drawer) providing a user with a choice of place to store the applicator.

Figure 7:
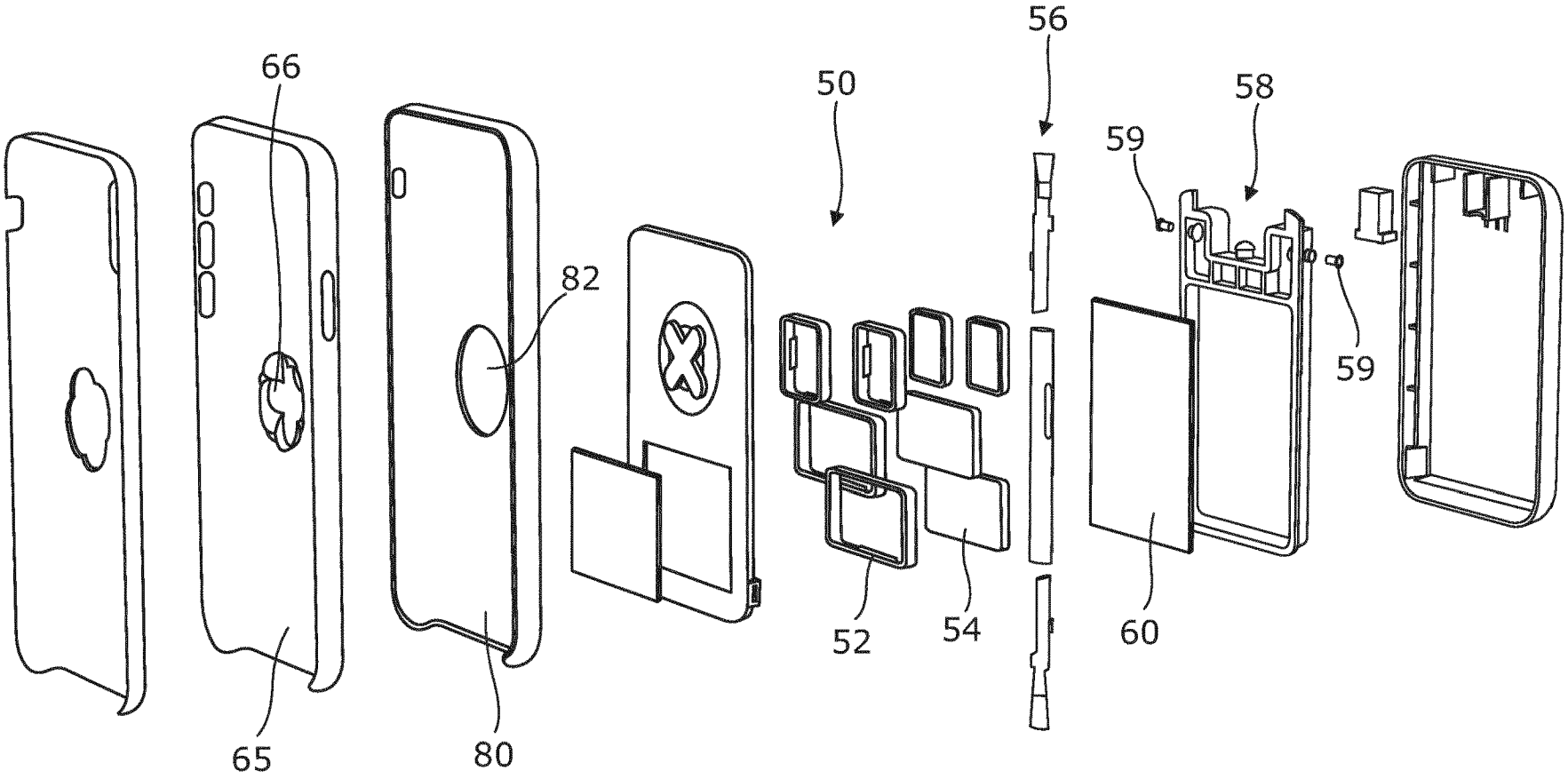
FIG. 7 shows a schematic exploded representation of a smart phone assembly according to a further embodiment.

FIG. 7 shows a schematic exploded view of a second embodiment. Some components are provided that are similar to those described above with reference to FIG. 3, although there are some significant differences between the embodiments.

Referring to FIG. 7, a tray assembly 50 is provided which is made up of a number of individual tray frames 52 together with make-up trays 54. Again, an applicator 56 is provided for arrangement within the make-up housing 58. The tray frames 52 are provided as individual components as opposed to within a predetermined array, as exemplified in, say FIGS. 5 and 6. This enables a user to selectively configure the make-up tray 58 to contain whatever arrangement or configuration of make-up and trays that is desired.

A magnetic sheet 60 is provided as described above with reference to FIG. 3, and this serves to provide magnetic interaction between the trays or metallic trays 55 and the magnetic sheet thereby ensuring that the trays 55 remain removably fixed within the make-up housing 58. An important aspect of this embodiment is that by virtue of the magnetic interaction between the make-up trays 54 and the magnetic sheet 60, a user is able to slide the trays on demand so as to vary the position of an individual make-up tray and its make-up when desired.

As described above, it is preferable that the magnetic force provided by the sheet is uniform across the entire surface area of the sheet, however it is possible in some embodiments that a variation can be achieved so as to make, for example, the applicator 56 easier to remove from the housing than the trays 50. In one embodiment, different regions of the magnetic sheet are arranged so as to define one region of higher magnetic field for an area for storage of a make-up tray that is unlikely to be changed and one region of lower magnetic field for an area for storage of a make-up tray that is more likely to be changed. The skilled person will appreciate that this can be set up as required or desired by design.

Figure 8:
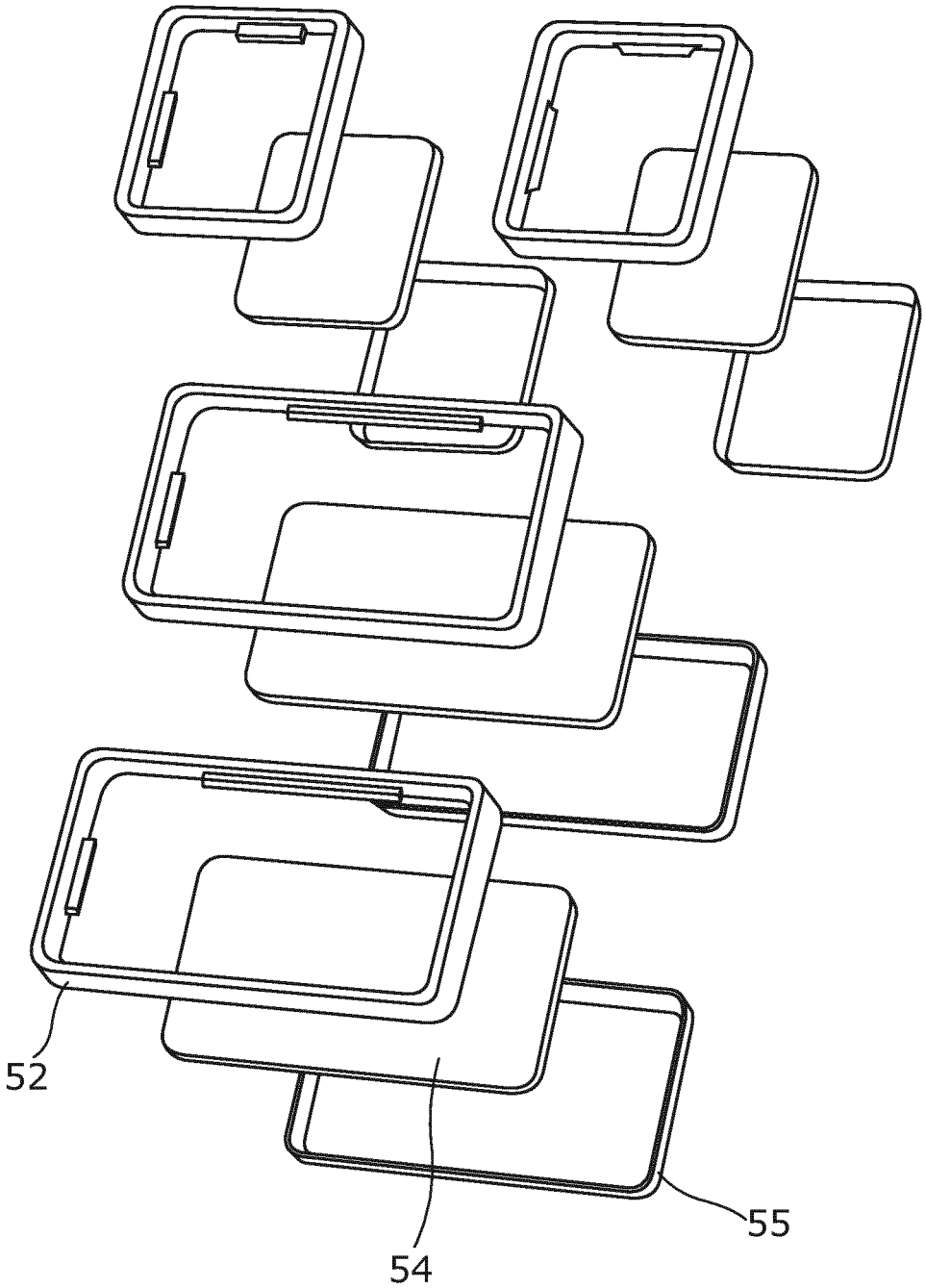
FIG. 8 shows a schematic reconfigurable Tray assembly for use in the assembly of FIG. 7.

FIG. 8 shows an exploded view of a tray and make-up tray assembly as shown in and described above with reference to FIG. 7. As can be seen metallic trays 55 are arranged to contain make-up 54 and are contained within tray frames 52.

It will be appreciated that any individual one or selection of the trays shown in FIG. 8 can be removed whilst the others retained.

Figure 9:
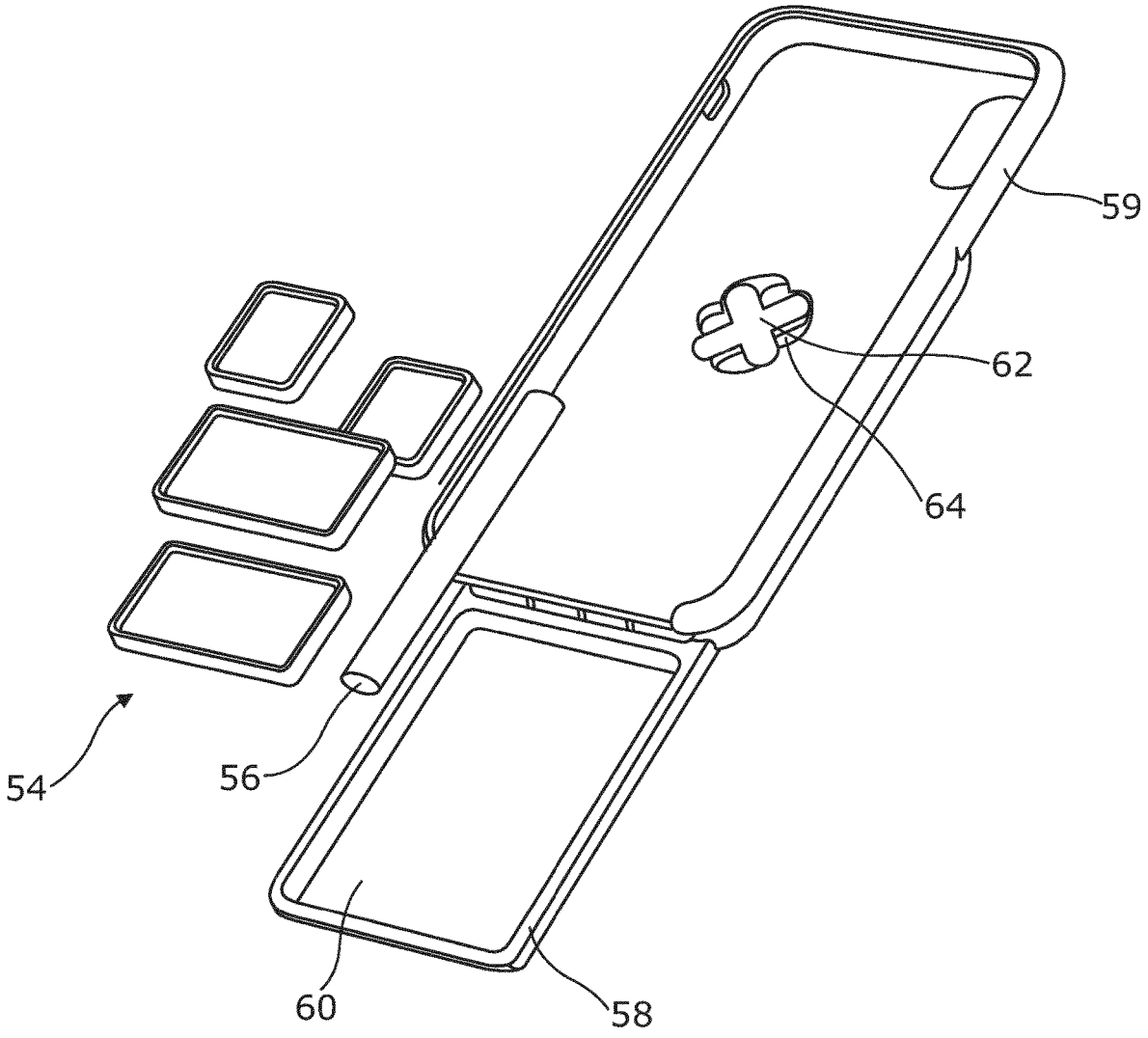
FIG. 9 shows component parts of an assembly according to FIG. 7.

FIG. 9 shows a schematic view of the assembly with the tray 58 having been slid from the case housing 59. The magnetic sheet 60 is visible as are the make-up trays and applicator (brush) 56.

A further significant aspect provided by this embodiment, either together with or independently of the reconfigurability and individual nature of the make-up trays relates to the entire removability of the slidable make-up tray assembly from the outer phone housing.

Referring to FIG. 9, as can be seen, a lock mechanism 62 is provided. In this non-limiting example, the lock mechanism is in the form of a rotatable cross arranged to engage with a suitable opening 64 in the rear surface of the housing of the mobile phone case.

Figure 10:
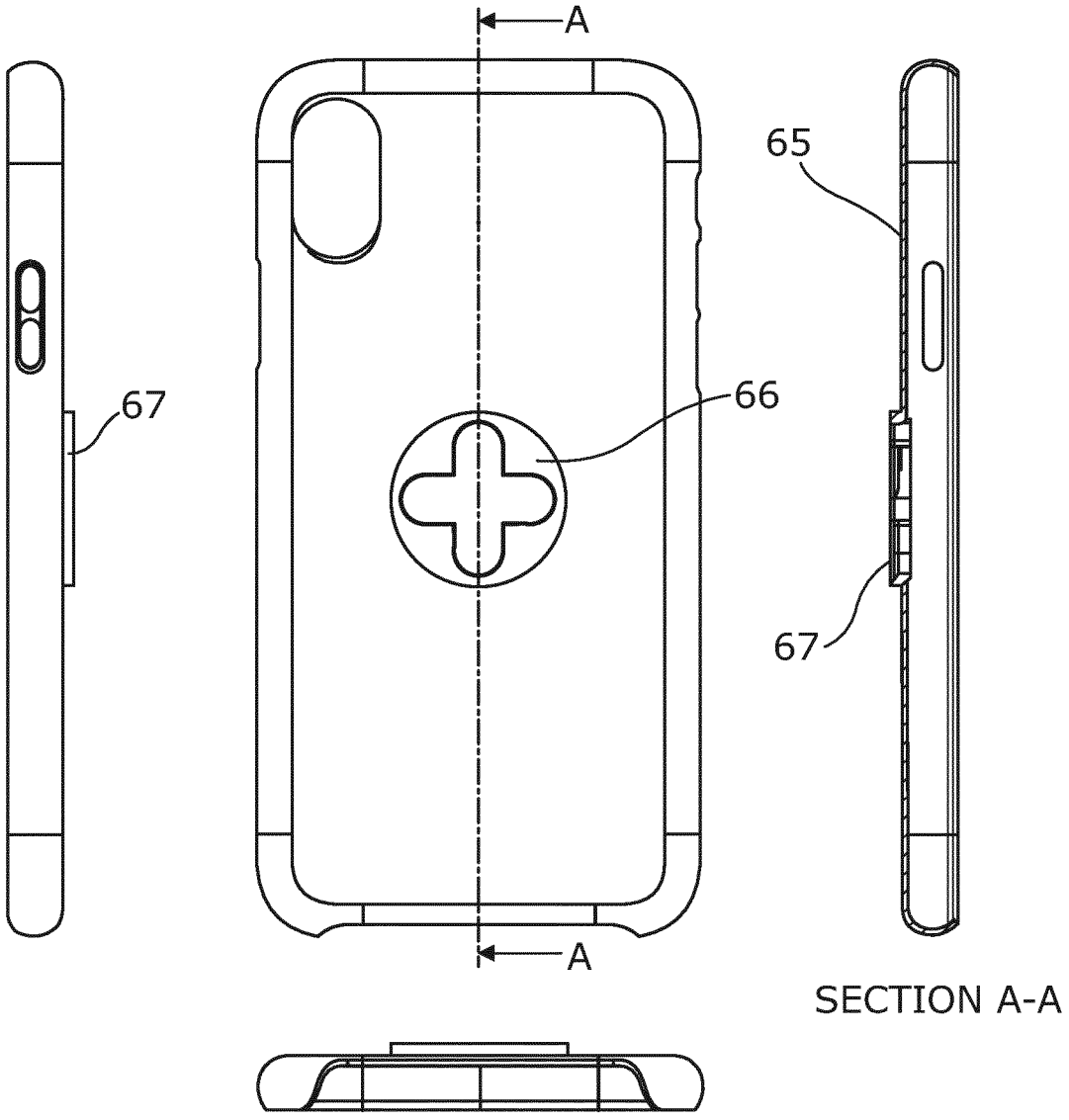
FIG. 10 shows views of the phone case shell from the assembly of FIG. 7.
Figure 11:
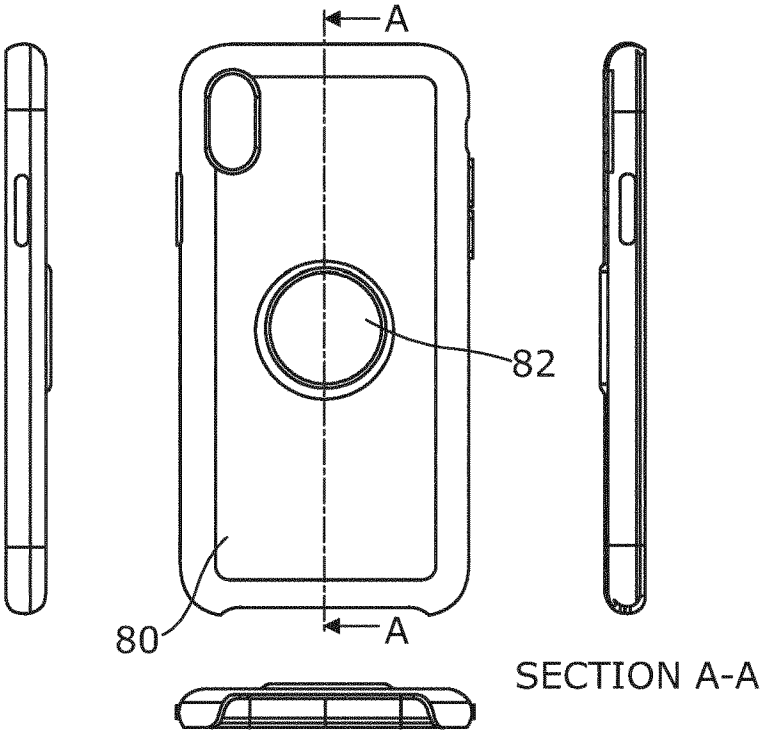
FIG. 11 shows an over mould assembly from the assembly of FIG. 7.

Referring to FIG. 10, the phone case shell is shown including a cross shaped opening 66 through which the cross 62 of the make-up case is arranged to be inserted when the case is connected. The cross shape opening 66 is formed within a circular projection 67 that projects above the planar surface 65 of the case back wall. FIG. 11 shows an overmold 80 of the assembly which includes an opening 82 shaped, wen assembled with the phone case shell to surround the projection.

Figure 12:
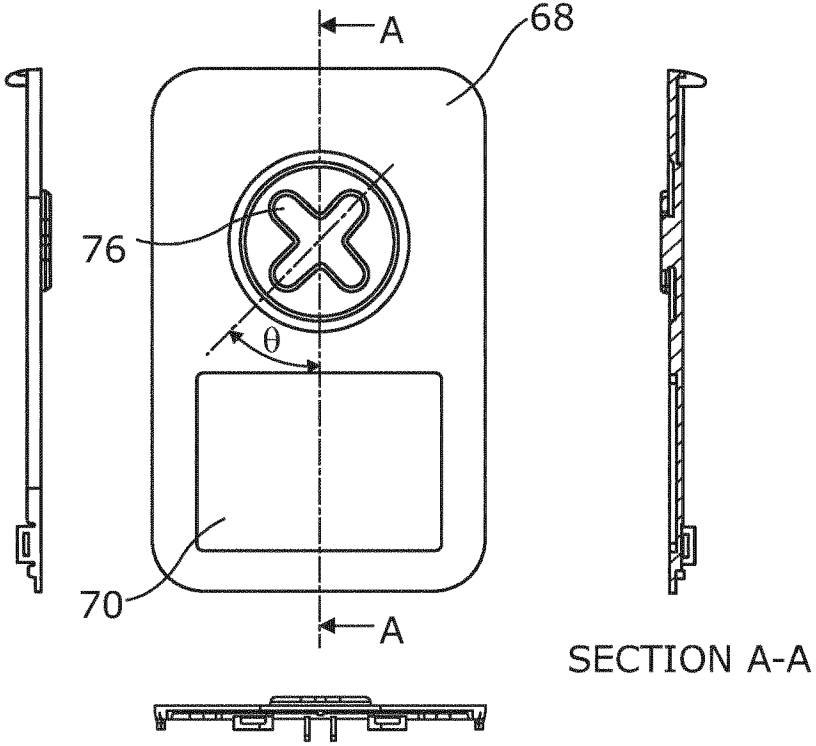
FIG. 12 shows the make-up case housing from the assembly of FIG. 7.

FIG. 12 is a view of components of the make-up case. A cross shaped locking member 76 is provided on an outer surface 68 of the make-up case. The surface 68 when connected to the phone case assembly, sits flush with the rear surface of the phone case itself. The cross shape opening 66 within the phone case shell is configured in a specific manner with respect to the axes of the shell. The cross shaped locking member 66 is provided on an outer surface 68 of the case to be out of phase, e.g. 45 degrees, with the cross shape opening such that when the make-up case and the phone case are aligned, the interaction between the cross shape opening and the cross shaped locking member 76 will lock the two together. To lock the two together, the cross shaped locking member 76 is aligned with the opening 66. It is then pressed against it and the make-up case is then rotated by 45 degrees relative to the phone case whilst he two are pressed together. The two will then be locked together and in effect define an integrated unitary (but separable when desired) component.

Figure 13:
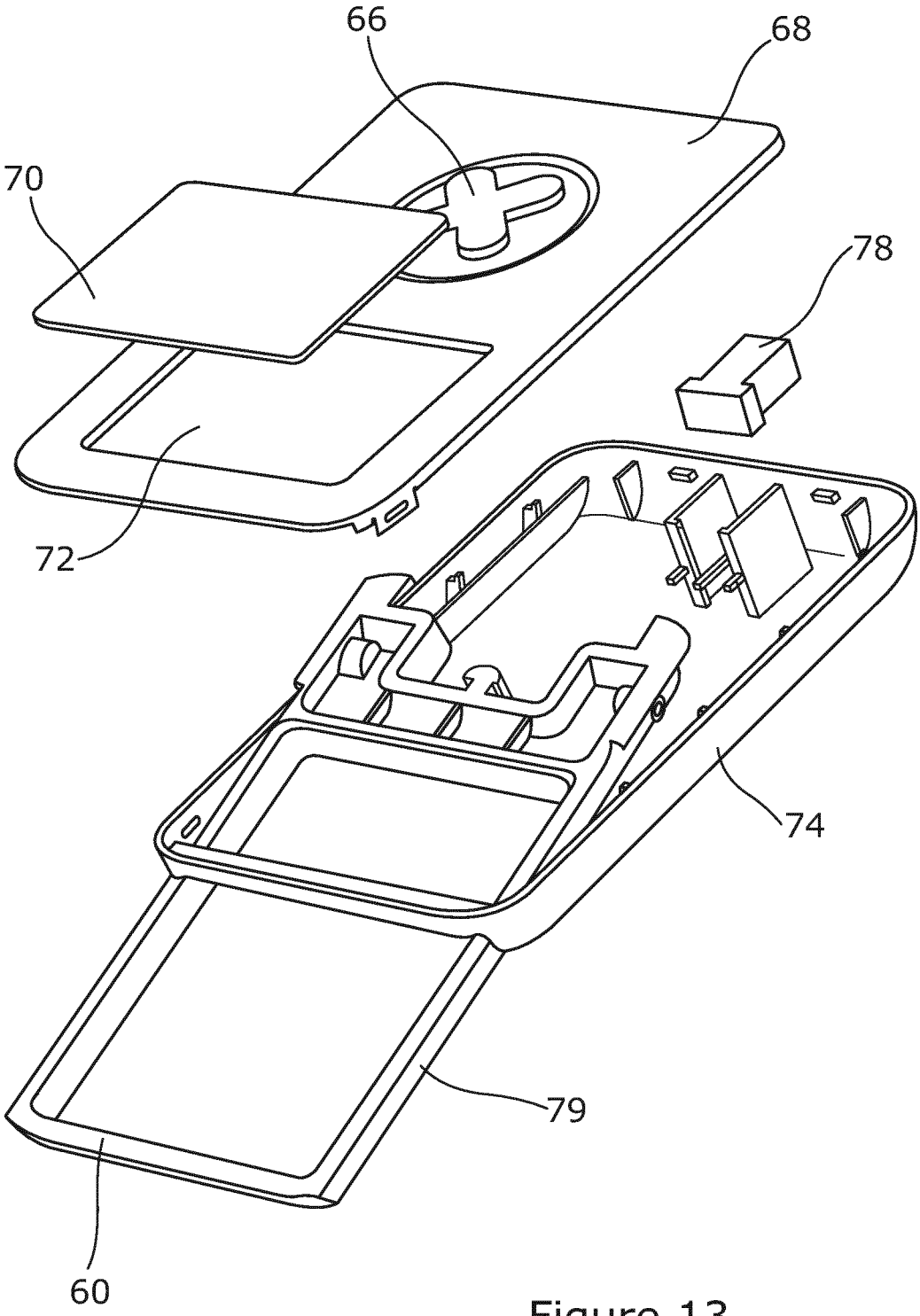
FIG. 13 shows a detached make-up case housing from the assembly of FIG. 7; and, FIGS. 14 and 15 show an alternative reconfigurable tray assembly.

A mirror 70 is provided which is arranged such that a user is able to apply make-up when the make-up assembly 18 is not fixed to the mobile phone case itself. In other words, the assembly shown in FIGS. 12 and 13 is an independent make-up case which a user can choose either to connect to their mobile phone case or not.

Referring again to FIG. 13, the removable make-up case comprises the engaging surface 68 with the locking member 66 described above. A mirror 70 is provided, in this example, arranged within a recessed region 72 on the surface 68. An outer casing 74 is provided which serves as the outer part of the make-up case when it is assembled with a mobile phone case as shown in FIG. 9.

In the example again, the make-up case comprises a slidable drawer 76 which is arranged to slide in and out of the outer housing 74. A locking latch member 78 is provided which serves to lock the drawer 79 in a closed configuration.

As described above with reference to FIGS. 7 to 13, a magnetic sheet 60 is provided within the drawer which enables selective reconfigurability of the individual make-up trays as already described above.

It will thus be appreciated that when the make-up case of FIG. 13 is not connected to the outer housing of the mobile telephone case, the mobile telephone case will in most respects, seem simply to be a well-known protective outer housing for a mobile telephone. However, the provision of the various openings enables the make-up case of FIG. 13 to be selectively and reconfigurably connected or disconnected from the mobile phone case defining therefore the assembly in its entirety. The locking member in the form of a cross shape opening and cross shape member is particularly useful in this example as it provides a way to easily and securely connect the make-up case to the mobile phone case. Furthermore, due to the cross shape of the interacting components (the opening 66 and locking member 76) a way of ensuring locking of the two cases is provided that also enables alignment when the two are locked. Other examples of locking system could also be used.

Figure 14:
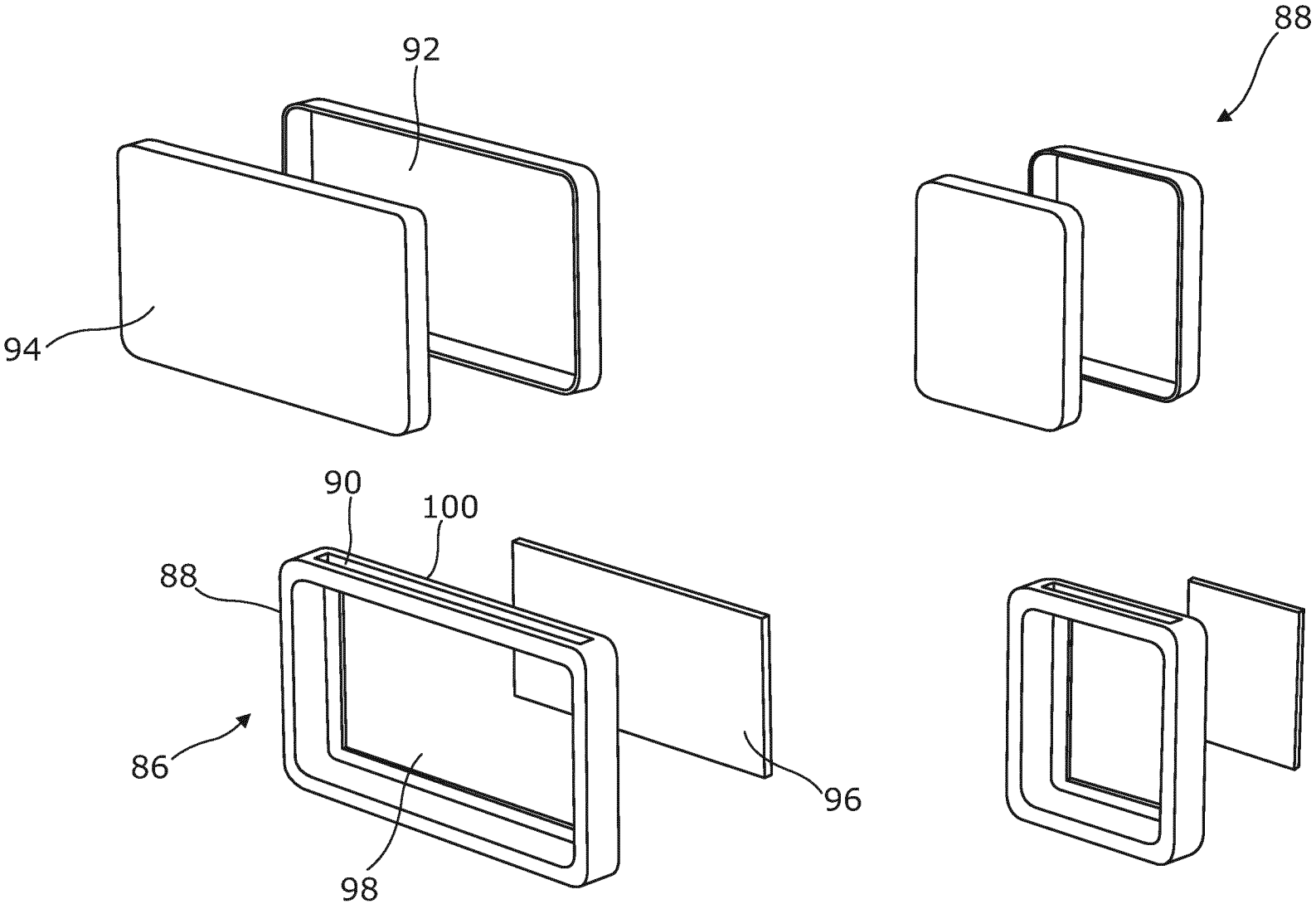
Figure 15:
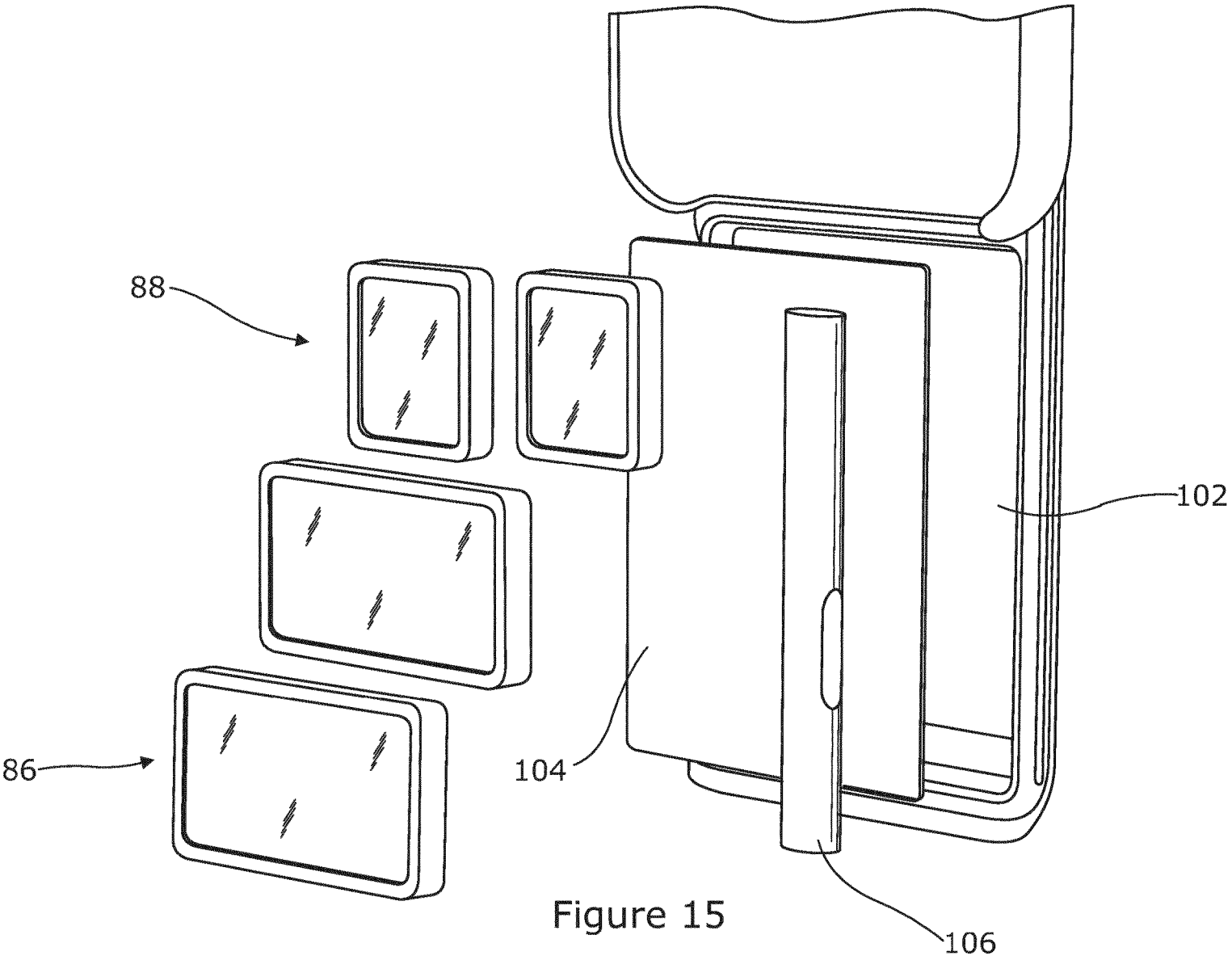

FIGS. 14 and 15 show an alternative reconfigurable tray assembly. In this example, a tray assembly is shown including both a full-size tray 86 and a half size tray 88. The general construction is the same, the two differing only in their sizes so although the following description will relate to the full-size tray 86, it will be appreciated that it applies equally to trays of other sizes too.

The tray assembly 86 includes a frame 88 having an opening 90 along one side. In use a tray 92 is filled with make-up 94 and can then be slid into the frame 88 through the opening 90 in the side. Once within the frame, an appropriately-sized magnetic sheet 96 is adhered to the back of the tray 92. The sheet 96 is sized so as to fit within the rectangular dimensions of the frame 88. In other words, the opening on the rear surface 98 of the frame 88 is sized so as to receive the magnetic sheet 96. The thickness of the magnetic sheet may correspond to the thickness of a side member 100 that defines one side of the opening 90 within the frame 88. Thus, the magnetic sheet 96 will sit flush with the rear plane of the frame 88.

Referring to FIG. 15, two full-size tray assemblies 86 and two half-size tray assemblies 88 are provided and are shown for arrangement within the drawer 102 as shown. A magnetic sheet 104 is provided within the drawer and, in use, will attract the magnetic sheets provided on the rear surfaces of the tray assemblies 86 and 88, ensuring a fairly solid and rigid magnetic engagement between the tray assemblies and the magnetic sheet 104, fixed within the drawer 102. A brush 106 is provided to magnetically interact with the magnetic sheet 104 to enable a user easily to remove the brush from the drawer when required. In use, each of the trays and tray assemblies is removably fixed in position within the drawer by virtue of the magnetic interaction between the tray or tray assembly and the drawer itself, as described above.

Embodiments of the present disclosure have been described with particular reference to the examples illustrated. However, it will be appreciated that variations and modifications may be made to the examples described within the scope of this description.

The invention claimed is:

1. An electronic device case, comprising:

a housing configured to hold an electronic device on a first side of the case;

a drawer provided on an opposite side of the case, slidably retractable from the housing, the drawer containing a removably arranged tray or tray assemblies for storing make-up, and being arranged to magnetically interact with a surface of the drawer, wherein the drawer containing the make-up is arranged to translate relative to the housing to move between an open position and a closed position;

a make-up applicator arranged within the drawer, the make-up applicator being configured to magnetically interact with a surface of the drawer to enable the applicator to be removably fixed in position within the drawer and to be released when gripped by a user; and a magnetic sheet arranged to cover a majority of an area of the drawer for engaging with make-up holding trays or tray assemblies or an applicator assembly, wherein a strength of a magnetic field generated by the magnetic sheet varies across the magnetic sheet so as to define at least one area of high magnetic field strength and one area of lower magnetic field strength, wherein areas proximate to a center of the magnetic sheet are provided with magnets or magnetic components to ensure that they have a stronger generated magnetic field than areas at sides of the magnetic sheet.

2. The electronic device case of claim 1, wherein the housing is sized to receive a mobile telephone.

3. The electronic device case of claim 2, wherein the housing is sized to receive a smartphone.

4. The electronic device case of claim 1, comprising a brush removably fixed in position within the drawer for release when gripped by a user.

5. The electronic device case of claim 4, in which the brush is formed of a metal arranged to be magnetically attracted to the magnetic sheet.

6. The electronic device case of claim 1, comprising a generally cylindrical brush sleeve and being arranged to be to be removably fixed in position within the drawer for release when gripped by a user.

7. The electronic device case of claim 6, wherein the sleeve contains within it one or more telescopically extending brush elements.

8. The electronic device case of claim 6, wherein the sleeve is metal and arranged to be magnetically attracted to the magnetic sheet within the housing.

9. The electronic device case of claim 1, wherein the drawer has a stop to limit an amount the drawer can be opened and to reduce a risk of undesired removal of the drawer from the housing.

10. The electronic device case of claim 1, wherein the magnetic sheet is a sheet of non-magnetic material with a number of discrete magnets positioned on or integrally within the sheet.

11. The electronic device case of claim 4, wherein the drawer has a stop to limit an amount the drawer can be opened and to reduce a risk of undesired removal of the drawer from the housing.

12. The electronic device case of claim 9, wherein the stop comprises a spring-biased projection.

* * * * *